United States Patent [19]

Eaton et al.

[11] 4,212,246

[45] Jul. 15, 1980

[54] FUZE ELECTRONIC CIRCUITRY

[75] Inventors: Jefferson O. Eaton, Ridgecrest; Wilbur B. Lunt, Idlewild, both of Calif.

[73] Assignee: The United States of America as represented by the Secretary of the Navy, Washington, D.C.

[21] Appl. No.: 910,543

[22] Filed: May 26, 1978

[51] Int. Cl.[2] ..... F42C 15/40

[52] U.S. Cl. ..... 102/270; 102/265

[58] Field of Search ..... 102/270, 265, 262, 221, 102/216, 211-214

[56] References Cited

U.S. PATENT DOCUMENTS

| | | | |
|---|---|---|---|
| 2,981,190 | 4/1961 | Will et al. | 102/216 |
| 3,332,077 | 7/1967 | Nard et al. | 343/7 |
| 3,703,145 | 11/1972 | Burkhardt et al. | 102/270 |
| 3,722,416 | 3/1973 | Lunt et al. | 102/270 |
| 3,734,021 | 5/1973 | McKenzie et al. | 102/270 |
| 3,747,531 | 7/1973 | Powell | 102/214 |
| 3,750,588 | 8/1973 | Nordgren | 102/270 |
| 3,844,217 | 10/1974 | Ziemba | 102/276 |
| 3,853,065 | 12/1974 | Apstein | 102/214 |
| 3,877,377 | 4/1975 | Rabinow | 102/214 |
| 3,924,233 | 12/1975 | Nastonero et al. | 102/213 |
| 3,924,536 | 12/1975 | Dick et al. | 102/213 |
| 3,976,012 | 8/1976 | Nordgren | 102/270 |

*Primary Examiner*—Charles T. Jordan

*Attorney, Agent, or Firm*—R. S. Sciascia; W. Thom Skeer

[57] ABSTRACT

Electric circuitry for fuze mode selection and safe and arm function in an anti-ship guided missile is disclosed. Circuitry provides optional proximity fuze selection, and automatic proximity fuze lockout in case of direct target impact. Target proximity encounter results in instantaneous warhead detonation while direct target impact results in delayed warhead detonation to provide time for target penetration.

7 Claims, 1 Drawing Figure

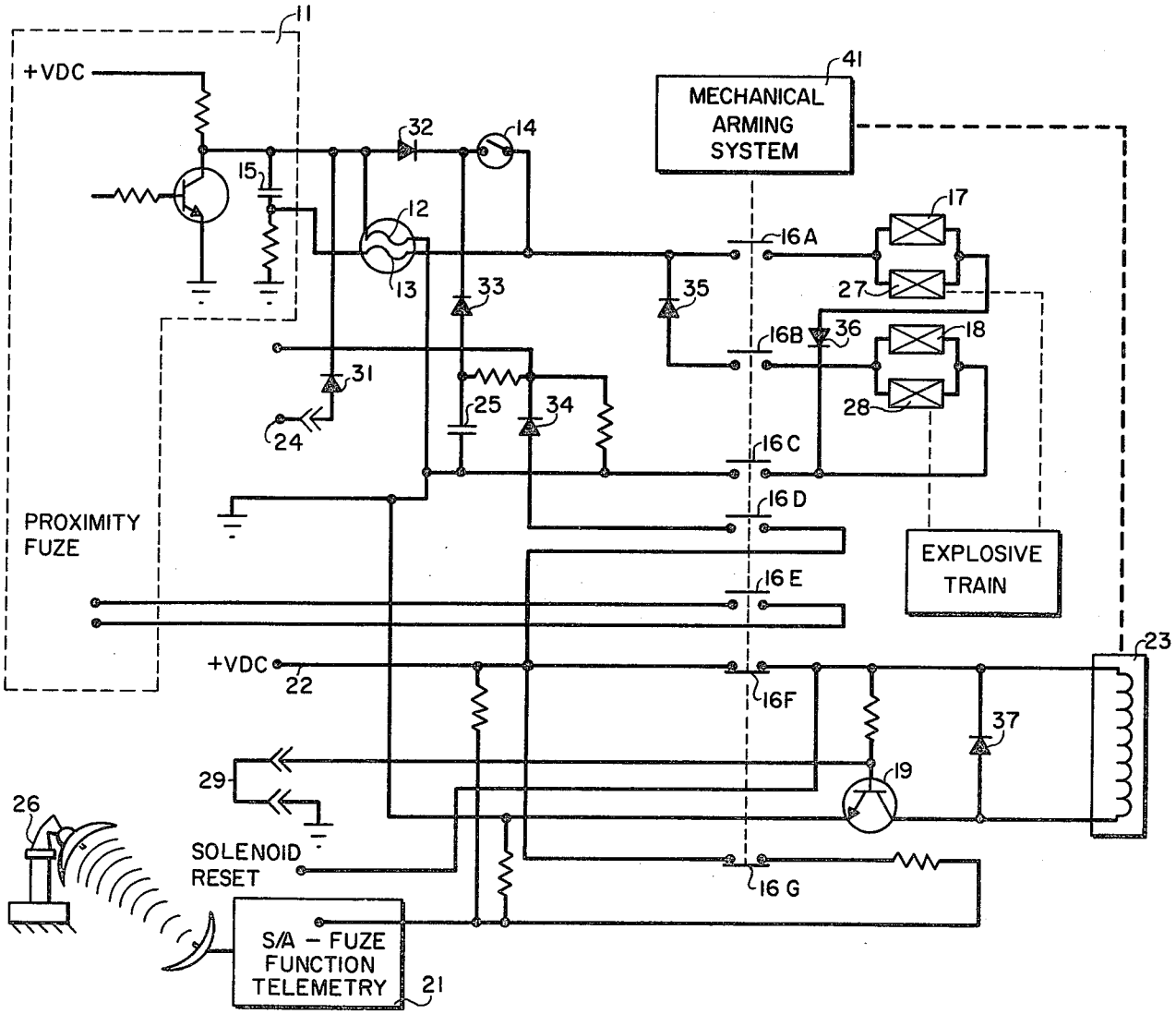
MECHANICAL ARMING SYSTEM
EXPLOSIVE TRAIN
PROXIMITY FUZE
S/A – FUZE FUNCTION TELEMETRY
+VDC
+VDC
SOLENOID RESET
11
12
13
14
15
16A
16B
16C
16D
16E
16F
16G
17
18
19
21
22
23
24
25
26
27
28
29
31
32
33
34
35
36
37
41

FUZE ELECTRONIC CIRCUITRY

BACKGROUND OF THE INVENTION

1. Field of the Invention

This invention pertains to electric circuitry associated with guided missile safe and arm devices and fuzing, and more particularly to such circuitry which provides optional fuzing modes depending upon the nature of target approach.

2. Description of the Prior Art

Ordnance fuzing circuits having detonation option selection circuitry are known in the art. U.S. Pat. No. 3,703,145 to Burkhardt et al. is one example of a fuze having detonation options. Such fuzes and circuitry, however, have complicated switching and timing components which make it more difficult to design a reliable fuzing circuit.

SUMMARY OF THE INVENTION

The problems of the prior art resulting from complexity and need for reliable fuzing components have been solved by the present invention. This invention uses a combination of fusible links, diodes, capacitors, resistors and an impact switch to interface between a proximity fuze and two types of detonators which either detonate instantaneously or after a predetermined delay. The proximity fuze remains inactive unless selected manually by the firing officer before launch by applying a voltage which burns out a fusible link grounding one side of the proximity fuze firing capacitor. A direct target impact causes the impact switch to simultaneously burn out a fusible link connecting the proximity fuze with the instantaneous detonators, while applying firing energy from a capacitor to the delay detonators.

A solenoid also removes a mechanical latch to permit an environmentally responsive arming mechanism to align an out of line explosive train and open or close a series of switches to electrically arm the warhead. The solenoid then locks the mechanism in the armed condition.

BRIEF DESCRIPTION OF THE DRAWING

A complete understanding of the present invention may be gained from a consideration of the following detailed description thereof in connection with the single FIGURE of the drawing which is schematic diagram of an electrical circuit according to the invention.

DESCRIPTION OF THE PREFERRED EMBODIMENT

The present invention may be used in conjunction with the inventions in assignee's copending patent applications identified as Ser. No. 915,030 filed June 12, 1978 and Ser. No. 910,544 filed May 26, 1978.

Described herein and illustrated in the single figure is the electrical circuitry used in the safe and arm device of an anti-ship guided missile. The missile carries proximity fuze 11 shown partially illustrated in the figure. Proximity fuzes are well known devices. At the option of the firing officer, proximity fuze 11 may be activated for use against small targets, but the preferred fuzing mode is target impact with deep target penetration prior to warhead detonation. The present invention, therefore, provides automatic proximity fuze lock out in the event of first target impact. The impact sensing switch 14 which performs this function, and which simultaneously initiates delayed warhead detonation, is an integral part of this circuit.

Warhead safing and arming functions, as well as those of fuzing mode slection and impact fuze initiation, require the highest order of system and component integrity and reliability. In this invention the described circuit performs its many functions with an absolute minimum of components, and each of these components has a proven high reliability established over a wide range of environments.

Referring now to the single drawing figure there is illustrated the electric circuitry of the present invention. The missile proximity fuze, partially shown and outlined by a dashed line labeled 11, includes firing energy capacitor 15 which stores firing energy which may be triggered by the proximity fuze circuitry in response to a close target encounter. Proximity fuzes are well know devices and the portion not illustrated is not necessary for a complete understanding of the present invention.

Fusible link 12 is installed in the circuit connecting one side of capacitor 15 with ground to prevent buildup of electric charge on capacitor 15. If the firing officer does not opt for activation of the proximity fuze, it is kept in this deactivated condition by the electrical ground via fusible link 12 which prevents charging the proximity fuze firing capacitor. If the firing officer does choose to activate the proximity fuze, a positive DC voltage is applied to point 24 via the missile umbilical cable, not shown. The resulting current through diode 31 burns open fusible link 12 on the way to power ground return. This removes the short circuit on proximity capacitor 15, which may now store a charge.

When the missile is put on internal power prior to launch, 28 volt DC power comes up at point 22. Then, at launch, as the umbilical cable pulls away from the missile, grounding short 29 is removed from the base of transistor 19. The resulting transistor current also flows through launch latch solenoid 23, unlocking the mechanical arming system 41. The explosive train has been kept physically out of line and electrically disabled by mechanical arming system 41 which employs air pressure from the flight environment to power movement from the safe to the arm condition. When the device is armed, switches 16A, 16B, 16C, 16D and 16E are closed, while 16F and 16G are opened. As the device reaches the armed position a latch operated by solenoid 23 falls back to permanently lock arming system 41 in the armed condition, ready to accept an electrical firing pulse from one of the two fuzing systems.

Switches 16A–16G are controlled by mechanical arming system 41. Switch 16G and a resistive network connected to terminal 21 delivers information describing the arming sequence progress of the device. This information may be recorded directly in a laboratory test of the device or may be monitored in-flight via radio telemetry to remote receiving station 26. Switch 16E must close before proximity fuze 11 can operate, although closure of switch 16E has no direct connection with the previously described optional selection of proximity fuze 11 by burning fusible link 12.

Switch section 16D closes to provide power to the impact fuzing system, which is housed entirely within the safety arming device of the present invention. Firing capacitor 25 charges via diode 34 and a current limiting resistor. Diode 34 prevents loss of once charged energy due to power supply failure. A high ohmage resistor connects between ground and capacitor 25 via the current limiting resistor to slowly bleed capacitor 25 after labratory testing.

Closure of switches 16A, 16B and 16C connect the electric detonators to the proximity and impact fuze firing systems. If after proximity fuze activation and missile launch, a near miss does in fact occur, and proximity fuze 11 triggers, a negative going firing pulse is delivered via fusible link 13, and diode 35 to instantaneous electric detonators 18 and 28. These instantaneous detonators cause detonation of the aligned explosive train and the missile warhead, not shown.

A direct target impact and subsequent deep missile penetration of the target prior to warhead detonation is the preferred action. Therefore, proximity fuze 11 is intentionally configured to be non-sensitive in the forward direction, and special provisions have been made to prevent initiation of the instantaneous detonators by the proximity fuze during the missile travel within the target.

At first target impact, impact sensing switch 14 momentarily closes, resulting in two separate but simultaneous actions. Impact sensing switch 14 is connected via diode 32 and fusible link 13, directly across proximity fuze firing capacitor 15. If capacitor 15 is charged, corresponding to proximity fuze 11 being selected by the firing officer, and subsequent enablement by closing of switch 16E occurs, closure of impact sensing switch 14 discharges capacitor 15 burning out fusible link 13, preventing initiation of instantaneous detonators 18 and 28 by proximity fuze 11. Also, closure of impact sensing switch 14 discharges capacitor 25 via diodes 33 and 36 to fire delay detonators 17 and 27. These delay detonators contain pyrotechnic materials which provide a relatively long delay time during which period the missile may penetrate deep within the target, prior to detonation and subsequent warhead initiation. Such pyrotechnic delay detonators are well known in the art.

Diode 35 prevents the impact fuze firing pulse from reaching instantaneous detonators 18 and 28. Diode 36 similarly prevents the proximity fuze from firing delay detonators 17 and 27, although this would have no deleterious effects on the mission. Without diode 36 the delay detonator bridges, not shown, would seriously sap the proximity fuze firing pulse energy, and thus impose severe penalties on the design of the proximity fuze firing circuit. Diodes 32 and 33 are included to mutually isolate the firing circuits of the two fuzing systems.

Diode 37 surpresses a reverse voltage spike appearing at solenoid 23 when switch 16F opens. Diode 31 serves to eliminate the possibility that capacitor 15 may be discharged through point 24.

What is claimed is:

1. An electric circuit for a proximity fuze with a safe and arm device having safe and armed conditions located within a guided missile, comprising:

electro-mechanical means for enabling said safe and arm device to arm in response to an electric input signal;

function monitoring means effectively connected to said electro-mechanical means for indicating safe and arm device function sequence progress;

grounding means, effectively connected to said electro-mechanical means, for preventing reception of said electric input signal by said electro-mechanical means;

instantaneous detonation means, effectively connected to said proximity fuze, for detonating an explosive train in response to a close target encounter signal from said proximity fuze;

proximity fuze disablement means effectively connected to said proximity fuze for preventing transmission of said close target encounter signal;

proximity fuze selection means effectively connected to said proximity fuze for selectively enabling said proximity fuze by disconnecting said proximity fuze disablement means;

delay detonation means effectively connected to said instantaneous detonation means for delaying detonation of said explosive train for a predetermined time period in response to a direct target impact by said guided missile; and circuit interruption means attached to said safe and arm device and effectively connected to said proximity fuze, said instantaneous detonation means, said delay detonation means, and said electromechanical means for controlling transmission of electric signals in response to the condition of said safe and arm device;

whereby selection of said proximity fuze and a close target encounter results in an instantaneous detonation of said explosive train, and a direct target impact always results in a delayed detonation of said explosive train so that a preselected time period is provided for target penetration by said guided missile.

2. An electric circuit as set forth in claim 1 wherein said grounding means has a separable link which disconnects from said electric circuit during launch of said guided missile and breaks circuit continuity between said electromechanical means and ground, thereby enabling reception by said electromechanical means of said electric input signal.

3. An electric circuit as set forth in claim 1 wherein said delay detonation means comprises a resistive and capactive network, an impact responsive switch connected to said network, and an electrically initiated pyrotechnic delay composition, connected to said network and configured for initiation by a firing signal from said network.

4. An electric circuit as set forth in claim 1 wherein said instantaneous detonation means comprises an electrically initiated detonator connected to said proximity fuze.

5. An electric circuit as set forth in claim 1 wherein said proximity fuze disablement means comprises a grounding conductor connected to said proximity fuze.

6. An electric circuit as set forth in claim 5 wherein said proximity fuze selection means comprises:

said ground conductor having a fusible link; and means for melting said fusible link.

7. An electric circuit as set forth in claim 3 wherein said delay detonation means further comprises a fusible link connected to said proximity fuze and to said electrically initiated detonator, and said impact responsive switch is connected to said proximity fuze and said fusible link whereby a direct target impact causes the impact responsive switch to close and form a short circuit for proximity fuze firing energy across said fusible link.

* * * * *